US009074836B1

(12) United States Patent
Saunders

(10) Patent No.: US 9,074,836 B1
(45) Date of Patent: Jul. 7, 2015

(54) ADJUSTABLE ANCHOR TAB

(71) Applicant: Thomas A. Saunders, Omaha, NE (US)

(72) Inventor: Thomas A. Saunders, Omaha, NE (US)

( * ) Notice: Subject to any disclaimer, the term of this patent is extended or adjusted under 35 U.S.C. 154(b) by 0 days.

(21) Appl. No.: 14/071,754

(22) Filed: Nov. 5, 2013

(51) Int. Cl.
*F41B 5/16* (2006.01)
*F41B 5/18* (2006.01)
*F41B 5/14* (2006.01)
*F41B 5/00* (2006.01)

(52) U.S. Cl.
CPC ..... *F41B 5/1473* (2013.01); *F41B 5/1469* (2013.01)

(58) Field of Classification Search
CPC ..... F41B 5/1473; F41B 5/1469
USPC ..... 124/35.2; 2/21, 161.5
See application file for complete search history.

(56) References Cited

U.S. PATENT DOCUMENTS 2,084,634 A * 6/1937 Flury ..... 124/35.2
2,133,650 A * 10/1938 Baker ..... 124/35.2
2,834,018 A * 5/1958 Farmes ..... 2/21
2,974,319 A * 3/1961 Wilson et al. ..... 2/21
2,996,059 A * 8/1961 Vance ..... 124/35.2
2,999,243 A * 9/1961 Gross et al. ..... 2/21
3,010,446 A 11/1961 Frantello
3,028,852 A * 4/1962 Sutton, Jr. ..... 124/35.2
3,224,009 A * 12/1965 Hoyt, Jr. ..... 2/21
3,229,304 A * 1/1966 Brooks ..... 2/21
3,246,338 A * 4/1966 Miller ..... 2/21
3,291,111 A * 12/1966 Smith ..... 124/23.1
3,608,090 A * 9/1971 Wilson ..... 2/21
3,749,076 A * 7/1973 Suski et al. ..... 124/31
3,818,888 A * 6/1974 Keeney et al. ..... 124/35.2
3,845,504 A * 11/1974 Killian ..... 2/21
4,097,931 A * 7/1978 Hirose ..... 2/21
4,332,233 A * 6/1982 Knoble ..... 124/35.2
4,458,659 A * 7/1984 Troncoso, Jr. ..... 124/35.2
4,539,970 A 9/1985 Griz
4,620,524 A * 11/1986 Saunders ..... 124/35.2
4,875,458 A * 10/1989 Young ..... 124/35.2
5,131,095 A * 7/1992 D'Amato ..... 2/21
6,571,787 B2 6/2003 Remaklus
7,654,254 B1 * 2/2010 Rentz et al. ..... 124/35.2
2003/0159682 A1 * 8/2003 Pellerite ..... 124/35.2
2013/0000007 A1 * 1/2013 Zumbo et al. ..... 2/21

* cited by examiner

*Primary Examiner* — Alvin Hunter
*Assistant Examiner* — Alexander Niconovich
(74) *Attorney, Agent, or Firm* — Dennis L. Thomte; Thomte Patent Law Office LLC

(57) ABSTRACT

An improved adjustable anchor tab is provided which includes a tab positioning assembly secured to the body member of the tab. Tab positioning assembly includes a rotatable wheel in one embodiment and includes a rotatable cylinder in another embodiment. The rotatable wheel of the first embodiment rotatably engages the lower inner side of the archer's mandible when in the anchor point. In the second embodiment, the roller extends at an angle with respect to the support upon which it is mounted.

9 Claims, 8 Drawing Sheets

ADJUSTABLE ANCHOR TAB

BACKGROUND OF THE INVENTION

1. Field of the Invention

This invention relates to an adjustable anchor tab and more particularly to an adjustable anchor tab including a rotatable member for ensuring that an archer will anchor at precisely the same place every time.

2. Description of the Related Art

Archery tabs are utilized primarily for the purpose of protecting the fingers of an archer's hand while pulling the bow string back and also for permitting a smooth release of the bow string without having it catch on a person's fingers which causes inaccurate shooting.

In order to shoot a bow accurately, an archer must draw the bow string back and anchor the drawstring hand against the archer's face at precisely the same place for every shot. If the archer anchors too high, the shot will be too low; and if the archer anchors too low, compared to the normal anchor position, the shot will be too high. Similarly, if an archer anchors to the left or to the right with respect to the archer's normal anchoring position, the shot will go to the respective side of the target in proportion to the anchoring misalignment.

In U.S. Pat. No. 4,620,524, an adjustable anchor tab is disclosed with that device having a vertically disposed abutment structure connected to the top of a spacer for abutting a side of the archer's chin for ensuring that the anchoring point of the archer's face is the same every time that the bow is drawn. However, although the anchor tab of the '524 Patent has met with commercial success, it has been found that the abutment structure which abuts a side of an archer's chin can move laterally with respect to the archer's chin, thereby affecting the shot.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An improved anchor tab is provided which includes an upstanding flexible body member having an upper end, a lower end, a first side edge, a second side edge, an inner side, and an outer side. The flexible body member has an elongated slot formed therein which extends inwardly from the first side edge thereof towards the second side edge thereof which is configured to receive an arrow therein. The flexible body member has a flexible loop extending from the second edge thereof. The anchor tab also includes a first support having an upstanding portion, with upper and lower ends, and a laterally extending position which extends transversely from the upper end of the upstanding portion. The upstanding portion of the first support is secured to the flexible body member at the inner side thereof adjacent the second side edge thereof. The upper end of the upstanding portion of the first support is disposed adjacent the upper end of the body member.

A second support is secured to the laterally extending portion of the first support which extends laterally outwardly therefrom. A tab positioning wheel is rotatably secured, about a generally horizontal axis, to the second support. The tab positioning wheel is configured to rotatably engage the lower inner end of the archer's mandible (lower jaw) with the lower end of the archer's mandible resting upon the second support.

In the preferred embodiment, the upstanding portion of the first support is selectively longitudinally adjustably secured to the body member. In the preferred embodiment, the second support is selectively laterally adjustably secured to the laterally extending portion of the first support. In the preferred embodiment, an optional finger spacer is positioned at the outer side of the body member.

A modified form of the invention is also disclosed wherein a tab positioning cylinder or roller is rotatably secured, about an axis which is offset from vertical, to the second support. The tab positioning cylinder of the second embodiment is configured to rotatably engage the lower inner side of the archer's mandible with the lower end of the archer's mandible resting on the second support.

A principal object of the invention is to provide an improved anchor tab.

A further object of the invention is to provide an improved adjustable anchor tab.

A further object of the invention is to provide an improved anchor tab which includes a tab positioning wheel which engages the lower inner end of the archer's mandible when the anchor tab is anchored.

A further object of the invention is to provide an improved anchor tab which enables the archer to position or anchor the nock end of the arrow at precisely the same position for every shot.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
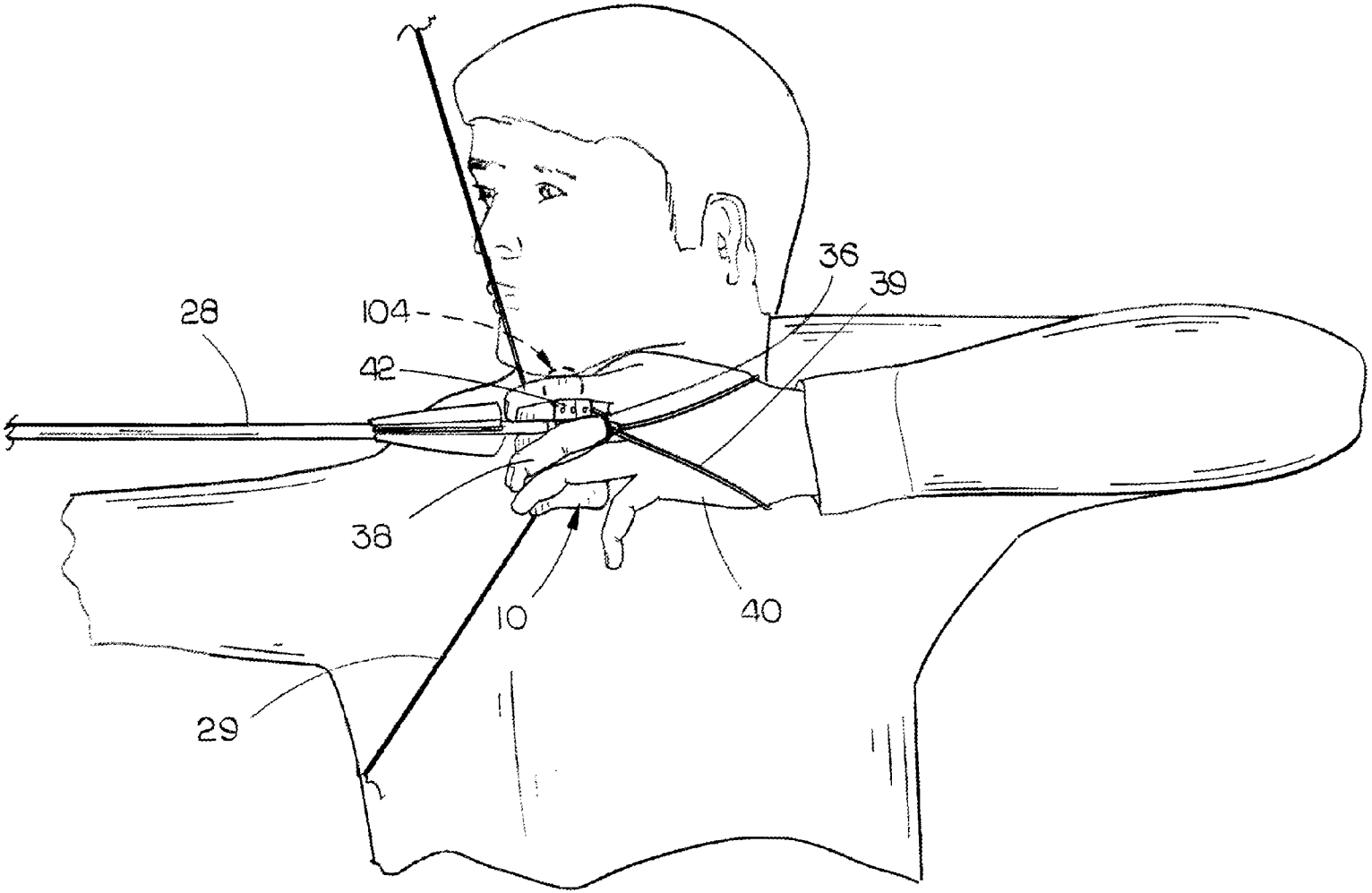
FIG. 1 is a perspective view illustrating the anchor tab of this invention being used by an archer.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The adjustable anchor tab of this invention is referred to by the reference numeral 10. The anchor tab 10 is shown as used by a left handed archer. The anchor tab 10 is reversible for use by a right handed archer. The tab 10 includes a flexible plastic body member 12 which has an upper end 14, a lower end 16, a first side edge 18, a second side edge 20, an inner side 22 and an outer side 24. A slot 26 extends inwardly from side edge 18 which is configured to receive an arrow 28 therein. The numeral 29 refers to a bow string which is a component of a conventional bow (not shown).

Preferably, a felt member 30 having the same general shape as body member 12 is positioned at the outer side 24 of body member 12. The felt member 30 is held in place by a pair of screws or bolts 32 and 34 as will be described in more detail hereinafter. As seen in the drawings, body member 12 has a flexible loop 36 extending from side edge 20 for receiving the middle finger 38 of the archer's hand 40. A larger flexible wrist loop 39 is secured to loop 36 as seen in the drawings. An optional finger spacer 42 is positioned at the outer side of body member 12 by means of a rivet 44 which extends through body member 12, felt member 30 and into finger spacer 42.

The numeral 46 refers to a tab positioning assembly which is attached to the body member 12, as will now be described. Assembly 46 includes a first support 48 comprised of an elongated, upstanding portion 50 having a lower end 52 and an upper end 54. Support 48 also includes a laterally extending portion 56 having an inner end 58 and an outer end 60. Upstanding portion 50 has a pair of elongated adjustment slots 62 and 64 formed therein. Laterally extending portion 56 has a pair of elongated adjustment slots 66 and 68 formed therein. A bend line 70 is provided between upstanding portion 50 and laterally extending portion 56 to permit the laterally extending portion 56 to be easily bent about bend line 70 so that laterally extending portion 56 may extend angularly from upstanding portion 50.

The numeral 72 refers to a second box-like support having a bottom wall 74, a first side wall 76, a second side wall 78, a first end wall 80 and a second end wall 82. The upper ends of side walls 76 and 78 have upwardly extending portions 84 and 86 respectively which have pin openings 88 and 90 formed therein respectively which are configured to receive pin 92 therein.

Figure 2:
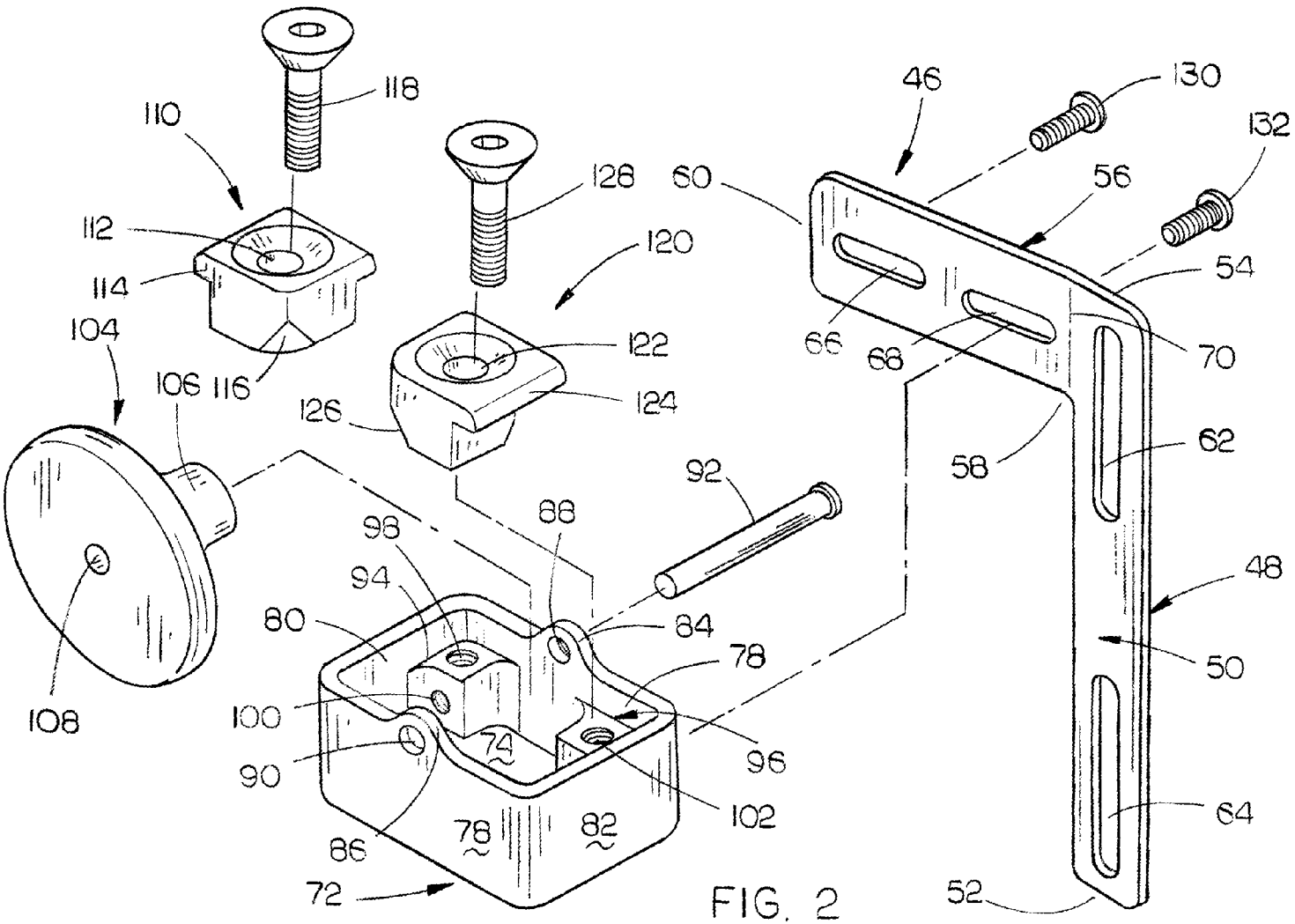
FIG. 2 is an exploded perspective view of the anchor assembly portion of this invention.
Figure 3:
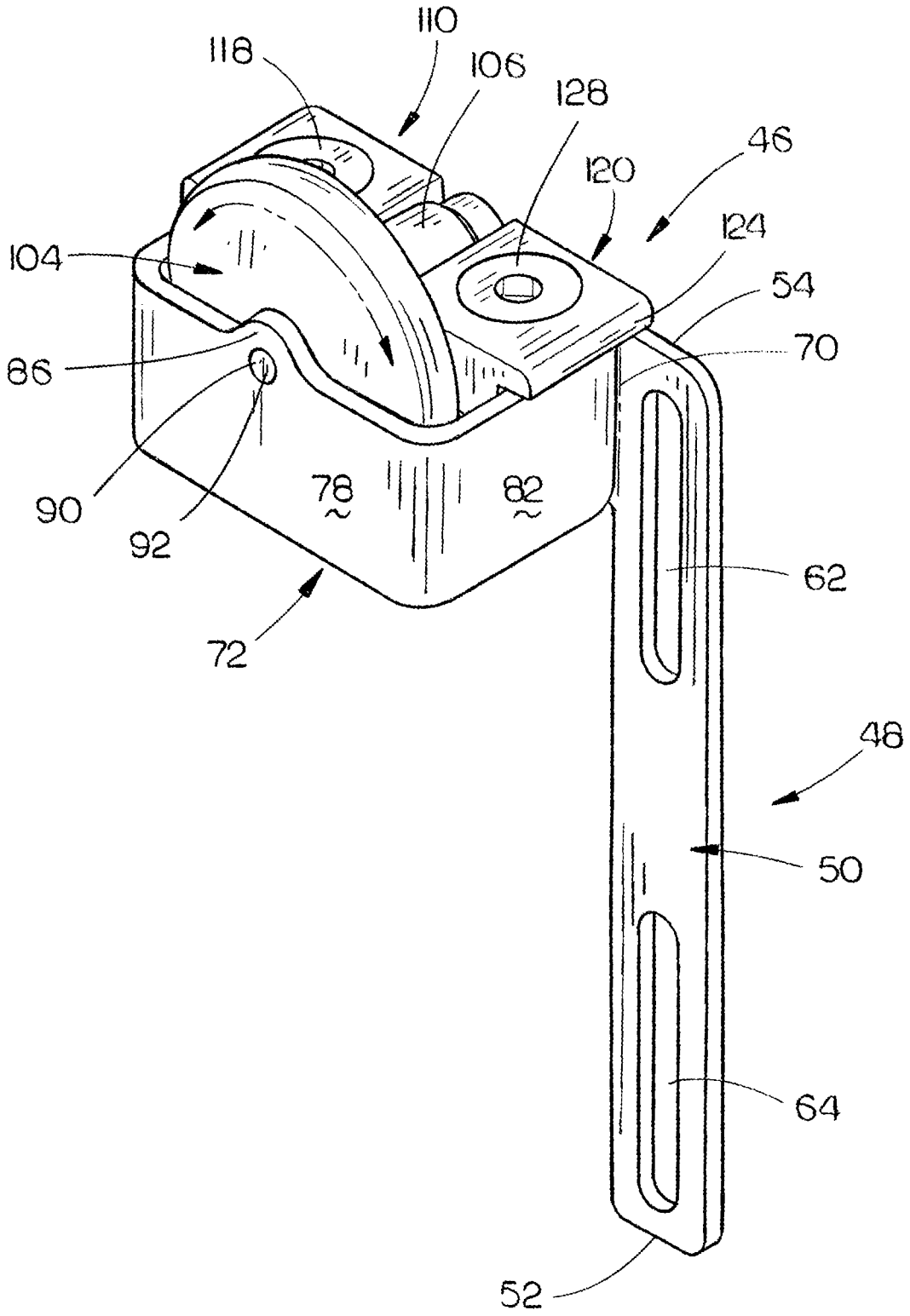
FIG. 3 is a perspective view of the anchor assembly portion of this invention.
Figure 4:
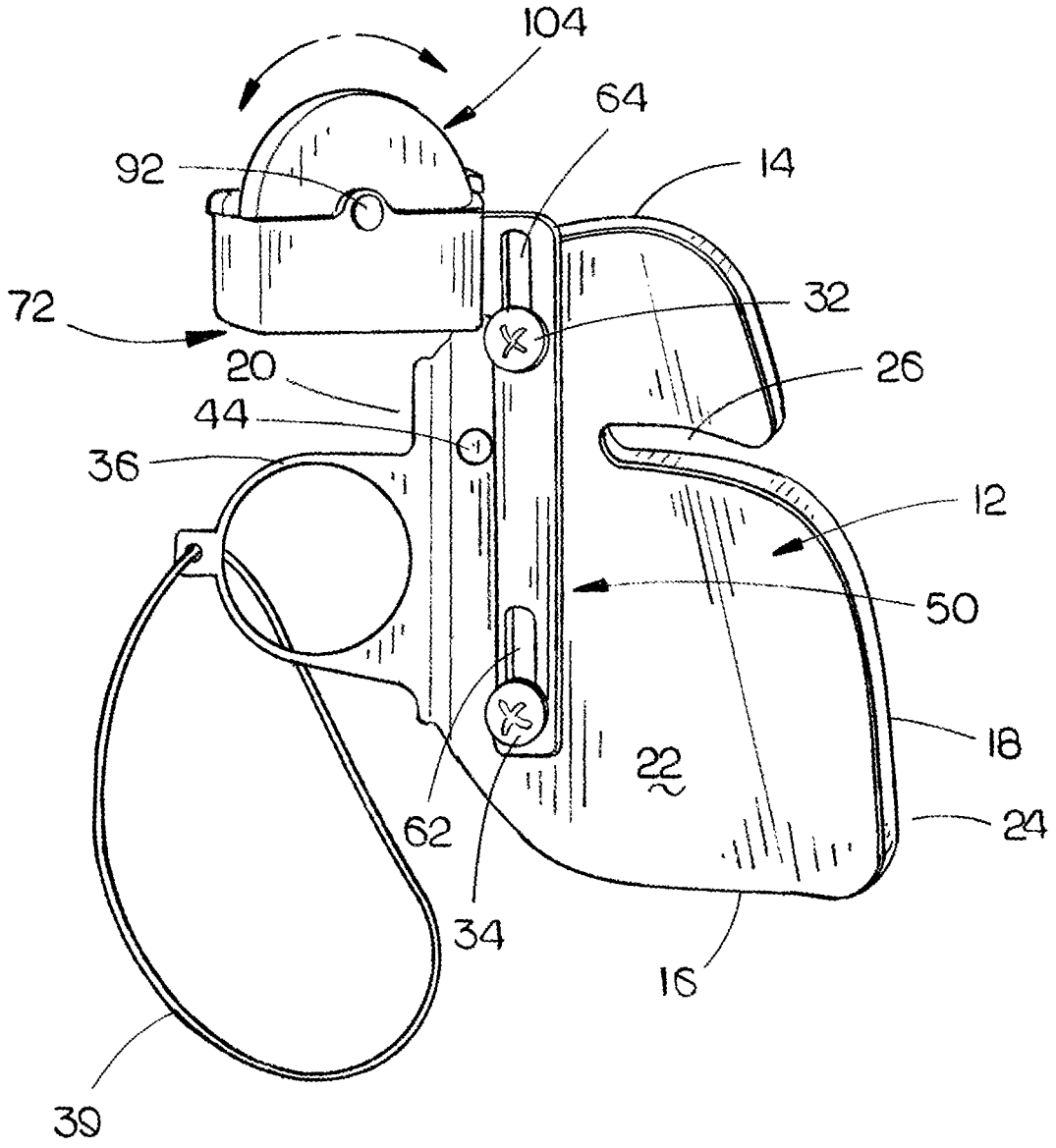
FIG. 4 is a perspective view of the anchor tab of this invention.
Figure 5:
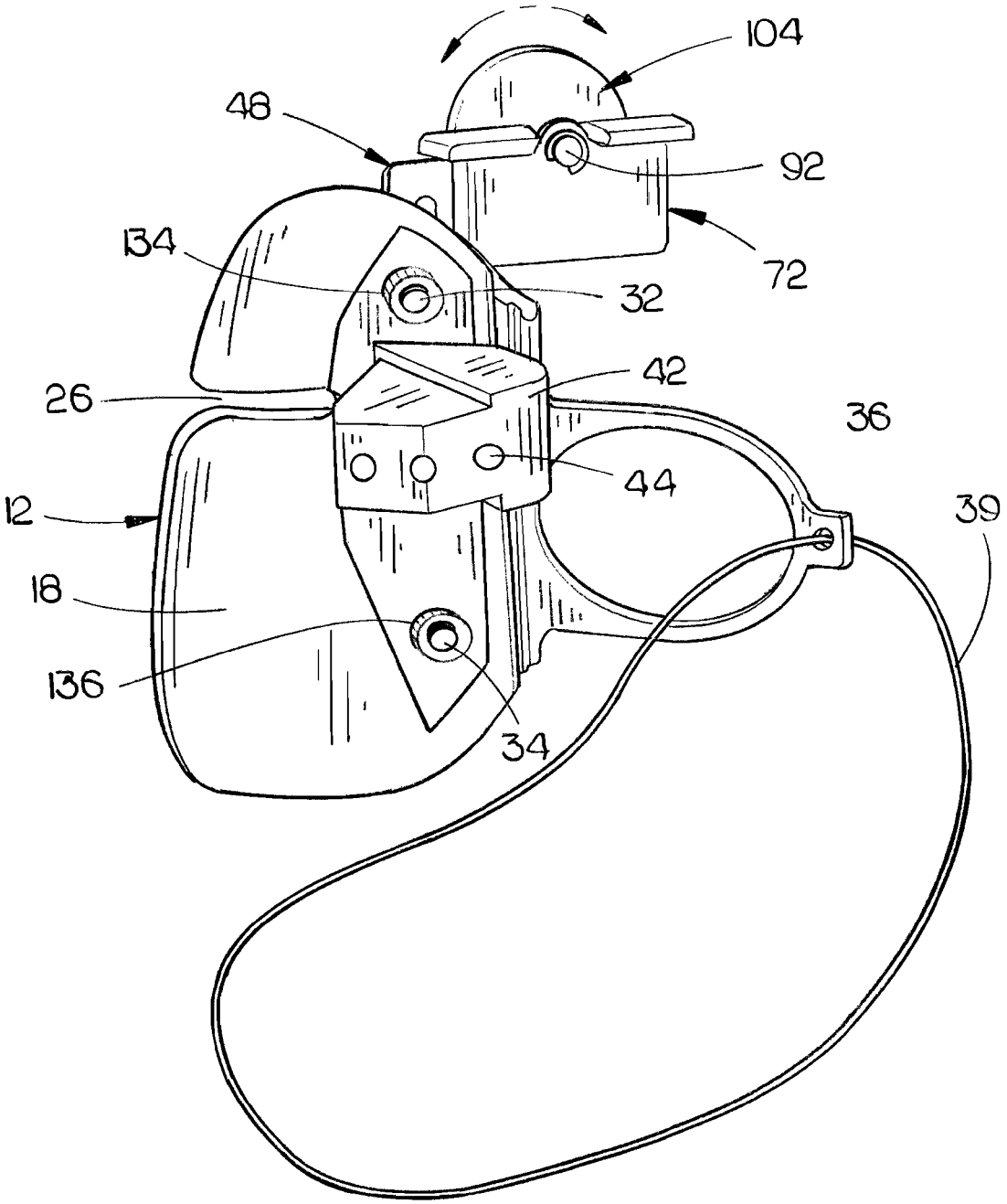
FIG. 5 is another perspective view of the anchor tab of this invention.

The interior of support 72 has a pair of spaced-apart blocks 94 and 96 provided therein, as seen in FIG. 2. Block 94 has transversely disposed, threaded openings 98 and 100 formed therein. Block 96 has a threaded opening 102 formed therein, as seen in FIG. 2, and a threaded opening (not shown) formed therein which corresponds to threaded opening 100 in block 94.

The numeral 104 refers to a tab positioning wheel which includes a hub 106. A bore 108 extends through wheel 104 which is configured to receive the pin 92 therein. As seen, wheel 104 is rotatably mounted within support 72 between walls 76 and 78 thereof. The numeral 110 refers to a support member having a countersunk opening 112 extending vertically therethrough. Support member 110 also includes a tapered tip or ledge 114 which extends from the upper end thereof. Support member 110 also includes a beveled portion 116 as seen in FIG. 2. Support member 110 is secured to block 94 by means of the bolt or screw 118 which extends downwardly through the countersunk opening 112 and which is threadably received by the threaded opening 98 in block 94. When support member 110 is secured to block 94, the lip or ledge 114 rests upon the upper ends of walls 76 and 80. When support member 110 is secured to block 94, the beveled portion 116 of support member 110 is positioned closely adjacent the hub 106 of wheel 104.

The numeral 120 refers to a support member having a countersunk opening 122 extending vertically therethrough. Support member 120 also includes a tapered lip or ledge 124 which extends from the upper end thereof. Support member 120 also includes a beveled portion 126 as seen in FIG. 2. Support member 120 is secured to block 96 by means of the bolt or screw 128 which extends downwardly through the countersunk opening 122 and which is threadably received by the threaded opening 102 in block 96. When support member 126 is secured to block 96, the lip or ledge 124 rests upon the upper ends of walls 76 and 82. When support member 126 is secured to block 96, the beveled portion 126 of support member 120 is positioned closely adjacent the hub 106 of wheel 104.

Support 72 is selectively laterally adjustably secured to laterally extending portion 56 of support 48 of tab positioning assembly by means of screws 130 and 132. Screw 130 extends through slot 66 of laterally extending portion 56 and is threadably received by the threaded opening 100 in block 94. Screw 132 extends through slot 68 of laterally extending portion 56 and is threadably received by the threaded opening in block 96 which corresponds to threaded opening 100 in block 94. Support 48 is selectively vertically adjustably secured to body member 12 by means of the screws 32 and 34 which extend through slots 62 and 64 thereof. Nuts 134 and 136 are threaded onto the ends of screws 32 and 34 respectively to hold support 48 in position.

Figure 7:
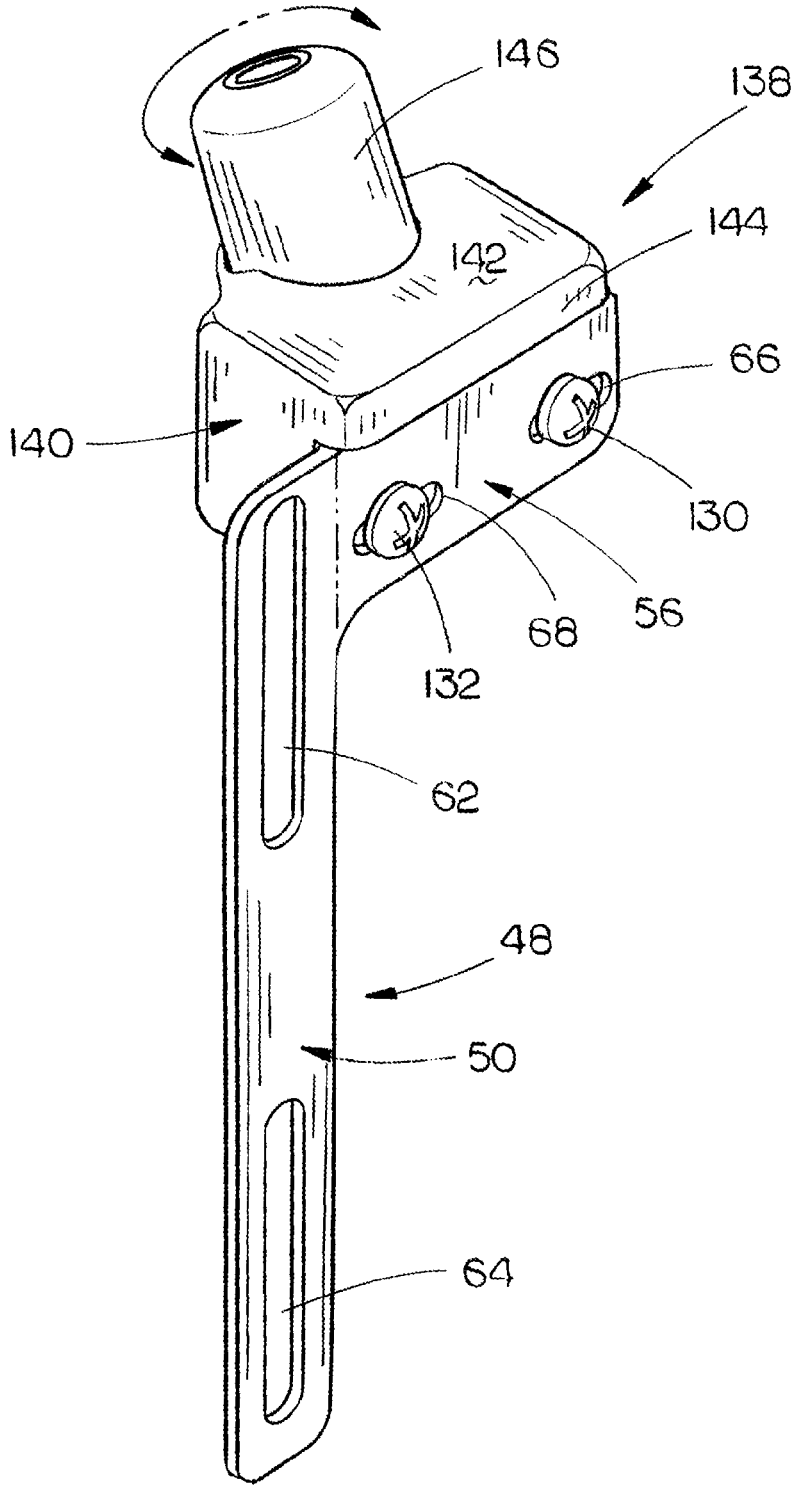
FIG. 7 is a perspective view of a modified form of the tab positioning assembly of this invention.

FIG. 7 illustrates a modified form of the tab positioning assembly which is designated by the reference numeral 138. The tab positioning assembly 138 includes the support 48 of the embodiment previously described. The tab positioning assembly 138 of FIG. 7 includes a box-like support 140 which is laterally adjustably secured to the laterally extending portion 56 by the screws 130 and 132. Support 140 includes an upper wall or top 142 which includes a lip or ledge 144 which is positioned on the upper end of laterally extending portion 56. Assembly 138 includes a rotatable member 146 in the form of a cylinder which extends upwardly and laterally from upper wall 142 at an angle of with respect thereto.

Figure 6:
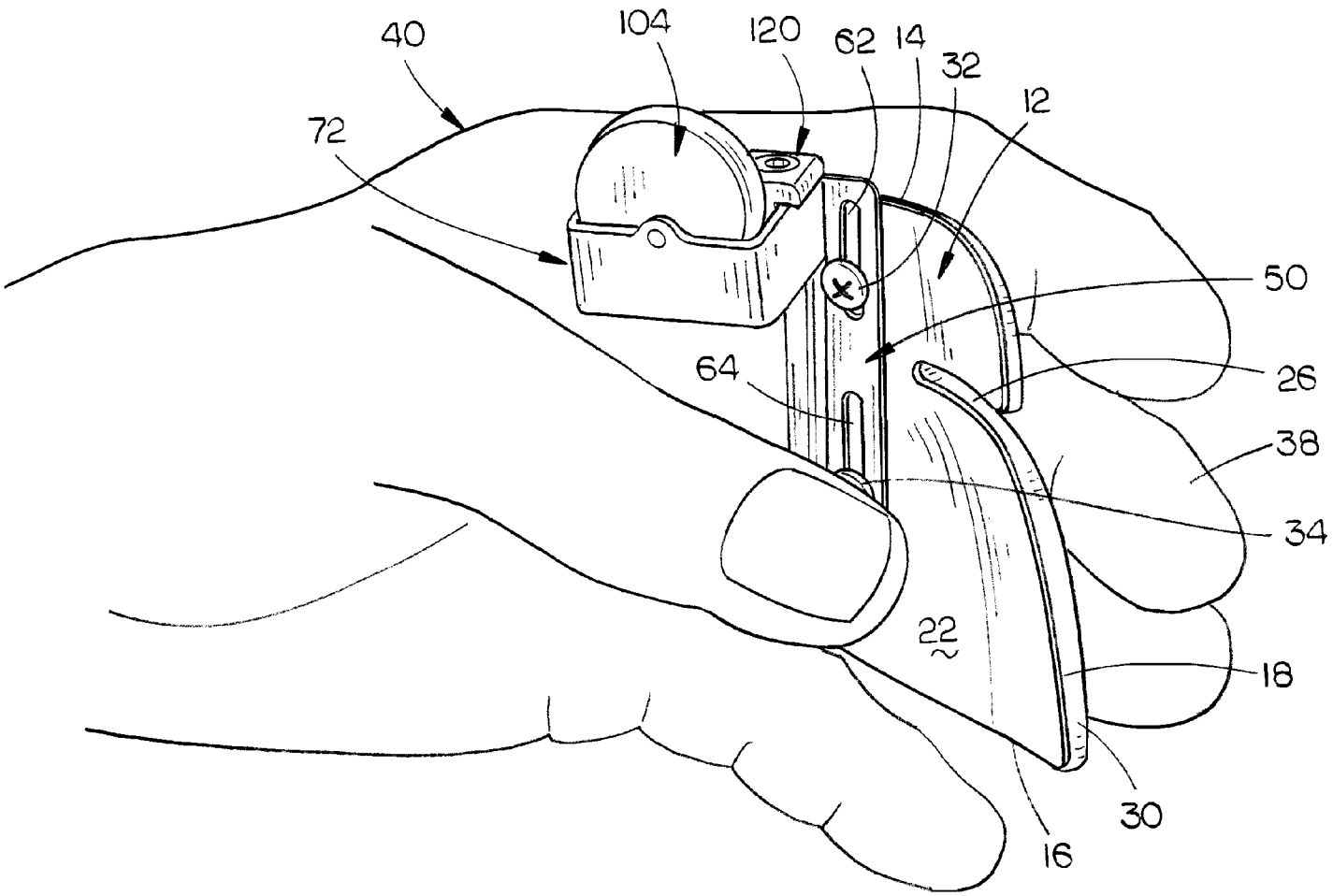
FIG. 6 is a perspective view illustrating the anchor tab of this invention being held in the hand of an archer.
Figure 8:
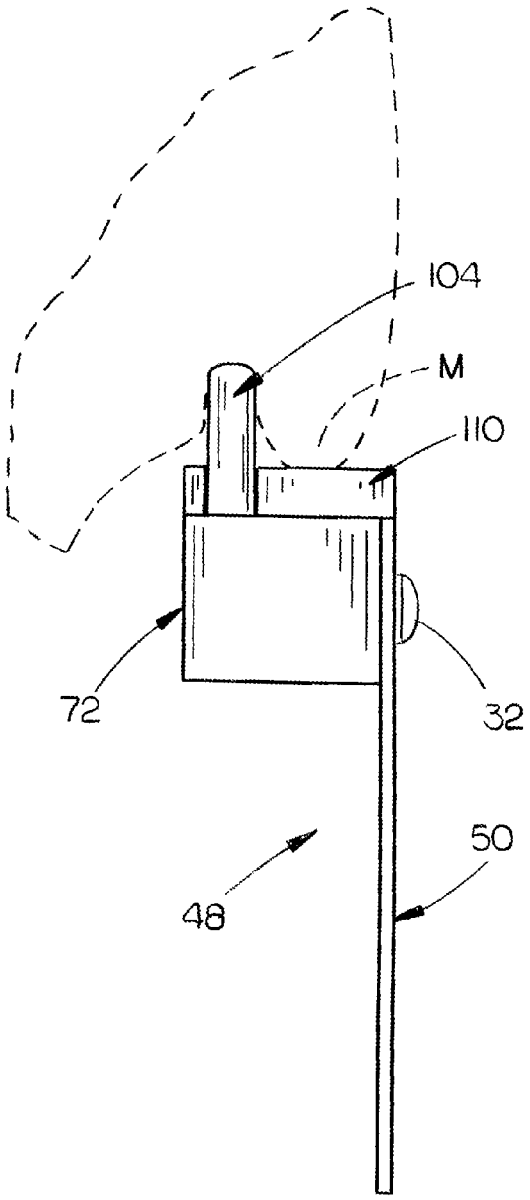
FIG. 8 is an end view illustrating the tab positioning assembly of FIGS. 1-6 in the anchor position.

With respect to the embodiment of FIGS. 1-6, the use of the adjustable anchor tab 10 will now be described. The larger loop 39 is first slipped onto the archer's wrist as seen in FIG. 1. The middle finger 38 of the archer's hand 40 is inserted or placed through the loop 36 (FIG. 1) and the top three fingers of the archer's hand are positioned adjacent the felt member 30 and the body member 12 as seen in FIG. 6. The arrow 28, nocked onto the string 29 of a bow (not shown), will then be in abutment with body member 12. The tab 10 is held so that the upper ends of the support members 110 and 112 on support 72 engage the underside of the archer's chin so that the mandible (lower jaw) M of the archer rests upon the support members 110 and 112 and so that the wheel 104 engages the lower inner side of the archer's mandible at the desired location as seen in FIG. 8. The wheel 104 enables the tab 10 to slightly move longitudinally with respect to the archer's mandible should the 10 be subjected to any recoil forces upon the arrow 28 being shot. The wheel 104 also enables the tab to be easily positioned at the desired anchor point.

If it is desired to move the position of the arrow 28 and the anchor point laterally left or right, the bolts or screws 130 and 132 are loosened and an appropriate adjustment of support 72 is made with respect to the laterally extending portion 56 of support 48. Once such adjustment is made, the bolts or screws 130 and 132 are tightened down to lock support 72 in position. If it is desired to move the position of the arrow at the anchor point upwardly or downwardly, then the screws or bolts 32 and 34 are loosened and an appropriate adjustment of body member 12 is made with respect to the upwardly extending portion 50 of support 48. Once such adjustment is made, the bolts or screws 32 and 34 are tightened down to lock support 48 with respect to the body member 12.

Figure 9:
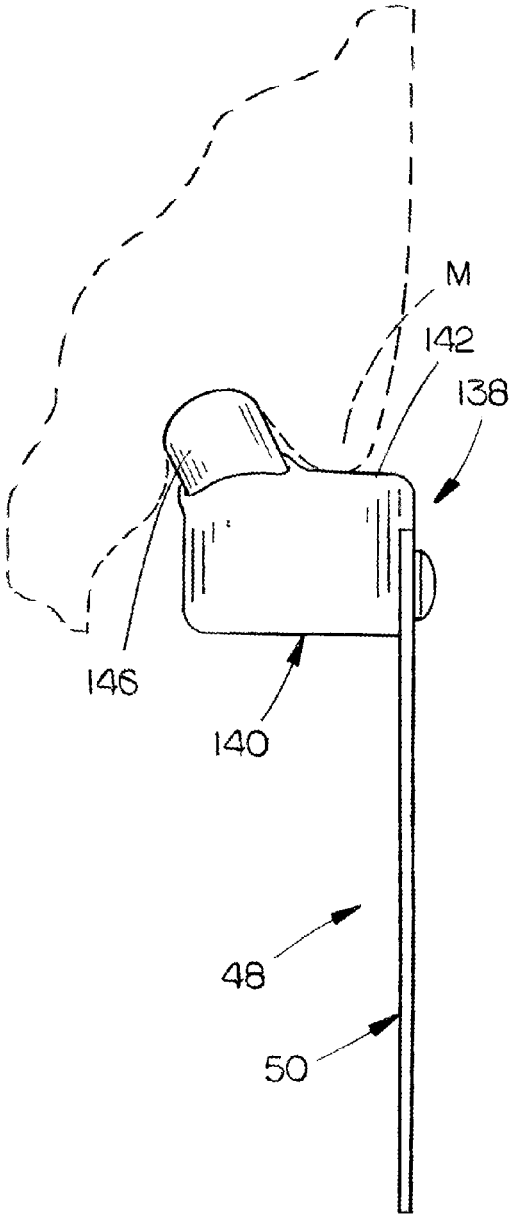
FIG. 9 is an end view of the modified form of the tab positioning assembly of FIG. 7 in the anchor position.

The primary difference between the embodiment of FIGS. 1-6, 8 and the embodiment of FIG. 7, 9 is that the rotatable cylinder 146 engages the archer's mandible at an angle as best seen in FIG. 9.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. An improved adjustable anchor tab, for use by an archer having a mandible with a lower inner end, comprising:

an upstanding flexible body member having an upper end, a lower end, a first side edge, a second side edge, an inner side and an outer side;

said flexible body member having an elongated slot formed therein which extends inwardly from said first side edge thereof towards said second side edge thereof which is configured to receive an arrow therein;

said flexible body member having a flexible loop extending from said second edge thereof;

a first support;

said first support including an elongated upstanding support portion, having upper and lower ends, and a laterally extending support portion extending transversely from said upper end of said upstanding support portion;

said upstanding support portion being selectively longitudinally movably secured to said body member;

said upper end of said upstanding support portion being disposed adjacent said upper end of said body member;

a second box-like support selectively laterally adjustably secured to said laterally extending support portion of said first support;

said second box-like support including a bottom wall, a first side wall with upper and lower ends, a second side wall with upper and lower ends, a first end wall with upper and lower ends, a second end wall with upper and lower ends, and an open upper end;

a tab positioning wheel rotatably mounted within said second box-like support between said first and second side walls whereby a portion of said tab positioning wheel is exposed above said upper ends of said first and second side walls and above said upper ends of said first and second end walls for rotatable engagement with the lower inner end of the archer's mandible.

2. The anchor tab of claim 1 wherein a finger spacer is positioned at said outer side of said body member.

3. The anchor tab of claim 1 wherein said second support has an upper end which is in engagement with the lower inner end of the archer's mandible when said tab engagement wheel is in engagement with the lower inner end of the archer's mandible.

4. An improved adjustable anchor tab for use by an archer having a mandible with a lower inner end, comprising:

an upstanding flexible body member having an upper end, a lower end, a first side edge, a second side edge, an inner side and an outer side;

said flexible body member having an elongated slot formed therein which extends inwardly from said first side edge thereof towards said second side edge thereof which is configured to receive an arrow therein;

said flexible body member having a flexible loop extending from said second edge thereof;

a first support;

said first support including an upstanding support portion, having upper and lower ends, and a laterally extending support portion extending transversely from said upper end of said upstanding support portion;

said upper end of said upstanding support portion being disposed adjacent said upper end of said body member;

a second box-like support secured to said laterally extending portion of said first support;

said second box-like support including a bottom wall, a first side wall with upper and lower ends, a second side wall with upper and lower ends, a first end wall with upper and lower ends, a second end wall with upper and lower ends, and an upper end;

a tab positioning roller rotatably mounted in said second box-like support and extending upwardly and laterally therefrom whereby a portion of said tab positioning roller is exposed above said second box-like support for rotatable engagement with the lower inner end of the archer's mandible.

5. The anchor tab of claim 4 wherein said upstanding first support is selectively longitudinally adjustably secured to said body member.

6. The anchor tab of claim 4 wherein said second support is selectively laterally adjustably secured to said laterally extending portion of said first support.

7. The anchor tab of claim 4 wherein a finger spacer is secured to and which is positioned at said outer side of said body member.

8. The anchor tab of claim 4 wherein said second support has an upper end which is in engagement with the lower end of the archer's mandible when said tab positioning roller is in engagement with the lower inner end of the archer's mandible.

9. The anchor tab of claim 4 wherein said tab positioning roller has a cylindrical shape.

* * * * *